United States Patent [19]

Yunoki

[11] Patent Number: 4,813,361

[45] Date of Patent: Mar. 21, 1989

[54] METHOD AND APPARATUS FOR APPLYING PROTECTIVE STRIP TO END OF SLIDE FASTENER

[75] Inventor: Akio Yunoki, Namerikawa, Japan

[73] Assignee: Yoshida Kogyo K. K., Tokyo, Japan

[21] Appl. No.: 212,238

[22] Filed: Jun. 27, 1988

[30] Foreign Application Priority Data

Jun. 30, 1987 [JP] Japan ..... 62-163700

[51] Int. Cl.[4] ..... D05B 3/12; D05B 37/04

[52] U.S. Cl. ..... 112/104; 112/113; 112/130; 112/DIG. 2; 112/121.27

[58] Field of Search ..... 112/104, 113, 130, 129, 112/307, DIG. 2, DIG. 3, 121.27, 121.26

[56] References Cited

U.S. PATENT DOCUMENTS

| | | | |
|---|---|---|---|
| 3,792,672 | 2/1974 | Friedman et al. | 112/104 |
| 4,497,270 | 2/1985 | Boser | 112/104 X |
| 4,502,399 | 3/1985 | Seaman | 112/104 X |
| 4,561,365 | 12/1985 | Schmidt et al. | 112/121.27 |
| 4,593,635 | 6/1986 | Boser et al. | 112/104 X |
| 4,674,422 | 6/1987 | Boser | 112/121.27 |
| 4,708,072 | 11/1987 | Frye | 112/130 X |

*Primary Examiner*—H. Hampton Hunter

[57] ABSTRACT

In a method and apparatus for applying a protective strip by sewing to an end of a slide fastener, a continuous protective strip is fed downwardly toward a tape supply position on the base of a sewing machine with its one surface facing opposite to a direction of feed of a slide fastener until a leading end portion of the protective tape overlays the base by a predetermined length, then the leading end portion is bent in a direction opposite to the fastener feed direction by a stream of pressurized air issued from an air nozzle, thereafter, a slide fastener is advanced along the base until its leading end reaches to a sewing position located downstream of the tape supply position, thereby causing the leading end portion of the protective tape to bend into a U-shape extending from the back to the face of the slide fastener around the leading end thereof, then the U-shaped leading end portion is cut from the continuous protective tape, thereby forming a U-shaped protective strip which in turn is sewn to the leading end of the slide fastener.

14 Claims, 7 Drawing Sheets

METHOD AND APPARATUS FOR APPLYING PROTECTIVE STRIP TO END OF SLIDE FASTENER

BACKGROUND OF THE INVENTION

1. Field of the Invention

This invention relates to a method and apparatus for applying a protective strip to one end of a slide fastener for use on infant garments, for example, so as to cover an end portion of a pair of interengaged coupling element rows of the slide fastener.

2. Description of the Prior Art

In the manufacture of garments, a continuous slide fastener chain having a pair of interengaged rows of coupling elements mounted respectively on a pair of continuous fastener stringers is first attached by sewing to a garment fabric and then cut off into individual slide fastener lengths, successively. The individual garment fabric with a slide fastener of individual length attached thereto is finally tailored into an infant garment. This conventional practice is efficient but is disadvantageous when used with a slide fastener chain having rows of continuous coiled or zigzag monofilamentary coupling elements because upon severance of the fastener chain, a cut end portion of the monofilamentary coupling element is likely to be deformed and project outwardly from the general plane of the fastener stringer. The garment fabric having such projecting coupling element end is harmful particularly when the garment fabric is tailored into an infant wear.

With this drawback in view, the free end of the interengaged coupling element rows is covered by a protective strip applied by sewing to the end of the slide fastener. The application of the projective strip has heretofore been performed manually by first placing a protective strip of a predetermined length on and around one end of a slide fastener, and while keeping this placement of the strip, then sewing the protective strip to the end of the slide fastener. Such manual application of the protective strip is tedious and time-consuming and hence the productivity of garments with the slide fasteners attached thereto is extremely low.

SUMMARY OF THE INVENTION

With the foregoing drawbacks in view, it is accordingly an object of the present invention to provide a method of semi-automatically applying a protective strip to one end of a slide fastener at an increased efficiency.

Another object of the present invention is to provide an apparatus for reducing the above method into practice.

According to a first aspect of the present invention, there is provided a method of applying a protective strip to an end of a slide fastener, comprising the steps of: (a) feeding a continuous protective tape downwardly toward a supplying portion on a base of a sewing machine located upstream of a sewing position in the sewing machine while keeping one surface of the protective tape facing opposite to a direction of feed of a slide fastener facing toward the sewing position until a leading end portion of the protective tape overlays the upper surface of the base by a predetermined length; (b) bending the leading end portion of protective tape toward the upstream side of the supply position along the upper surface of the base; (c) then feeding a slide fastener in the feed direction until a leading end of the slide fastener reaches the sewing position, thereby causing the leading end portion of the protective tape to bend into a U-shape extending from the back to the face of the slide fastener around the leading end thereof; (d) thereafter cutting off the U-shaped leading end portion from the protective tape, thereby forming a U-shaped protective strip extending around the leading end of the slide fastener; and (e) sewing the U-shaped protective strip and the leading end portion of the slide fastener together by operating the sewing machine.

According to a second aspect of the present invention, there is provided an apparatus for applying a protective strip to an end of a slide fastener, comprising: (a) a sewing machine including a base and a sewing needle reciprocably disposed above a sewing position defined on an upper surface of the base, the base further defining on its upper surface a tape supply position located upstream of the sewing position; (b) an intermittent tape feed unit disposed above the tape supply position on the base for intermittently feeding a continuous protective tape downwardly toward the tape supply position while keeping one surface of the protective tape facing in a direction opposite to a direction of feed of a slide fastener facing toward the sewing position until a leading end portion of the protective tape overlays the upper surface of the base by a predetermined langth; (c) a tape guide block disposed between the intermittent tape feed unit and the base and spaced upwardly from the upper surface of the base so as to define therebetween a fastener-receiving space for the passage of double layers of the protective tape and the slide fastener, the tape guide block having a substantially vertical tape guide channel for guiding therealong the protective tape (d) a cutter assembly disposed adjacent to a lower end of the tape guide channel in the tape guide block for cutting off the leading portion of the protective tape from the continuous protective tape; and (e) bending the leading end portion of the protective tape toward the direction along the upper surface of the base.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 10:
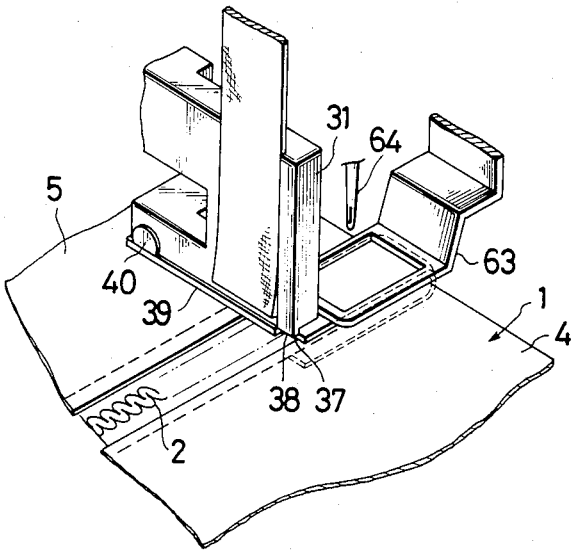
Figure 11:
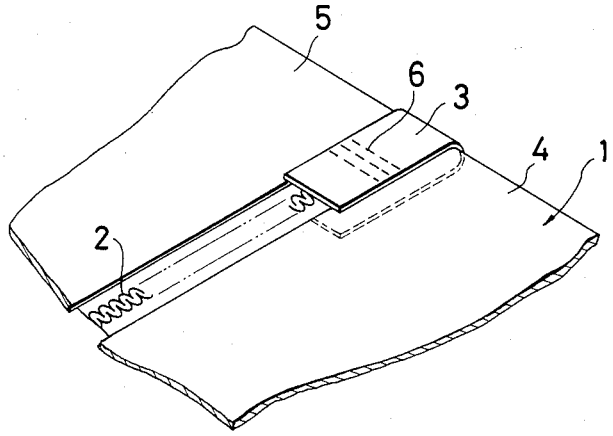
FIG. 11 is a fragmentary perspective view of one end of a slide fastener having a protective strip applied thereto according to the present invention.

FIG. 11 shows a portion of a slide fastener 1 including a protective strip 3 applied to an end of the slide fastener 1 according to the present invention. The protective strip 3 is attached by sewing stitches 6 to one end of a pair of opposed fastener stringers 4,5 so as to cover an end of a pair of interengaged rows of coupling elements 2. The application of the protective strip 3 to the slide fastener 1 is achieved on an apparatus shown in FIGS. 1 through 10.

Figure 1:
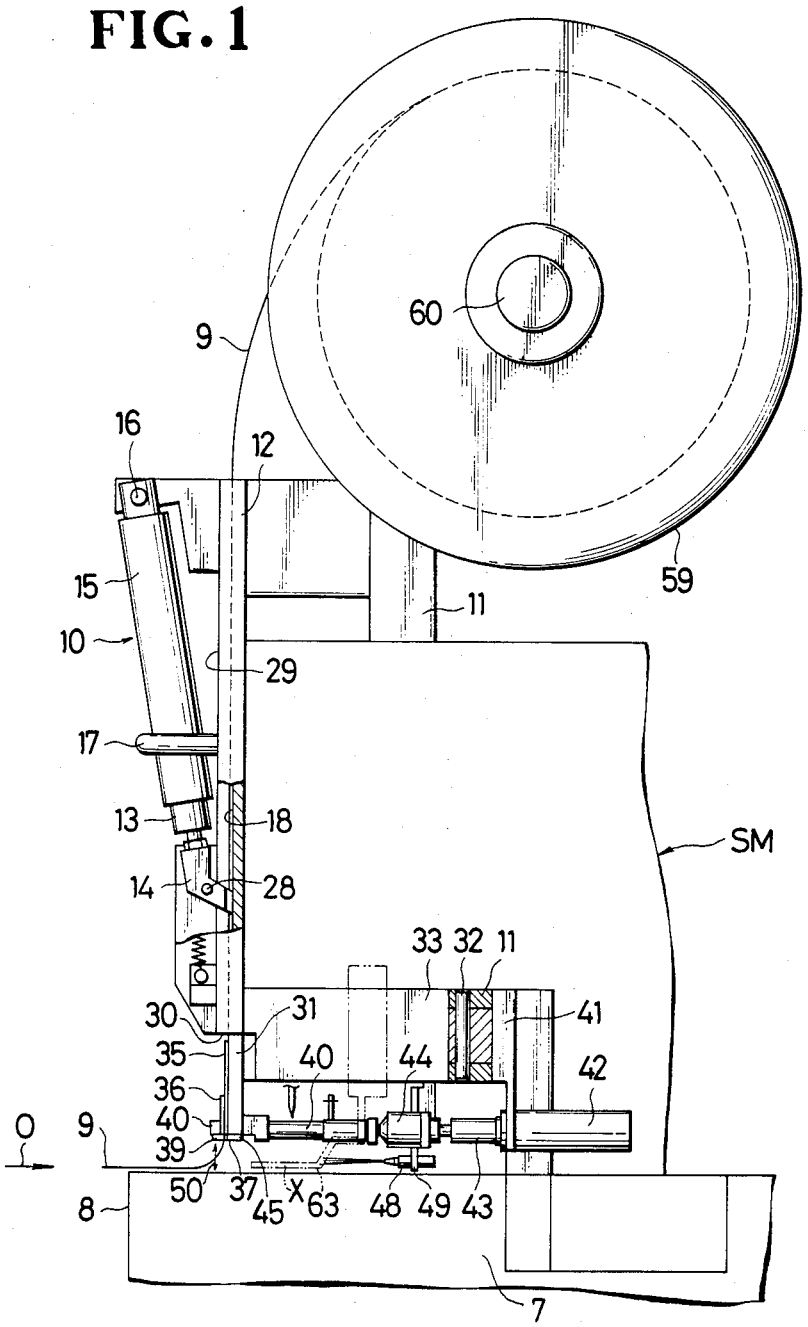
FIG. 1 is a fragmentary side elevational view, partly in cross section, of an apparatus according to the present invention.
Figure 2:
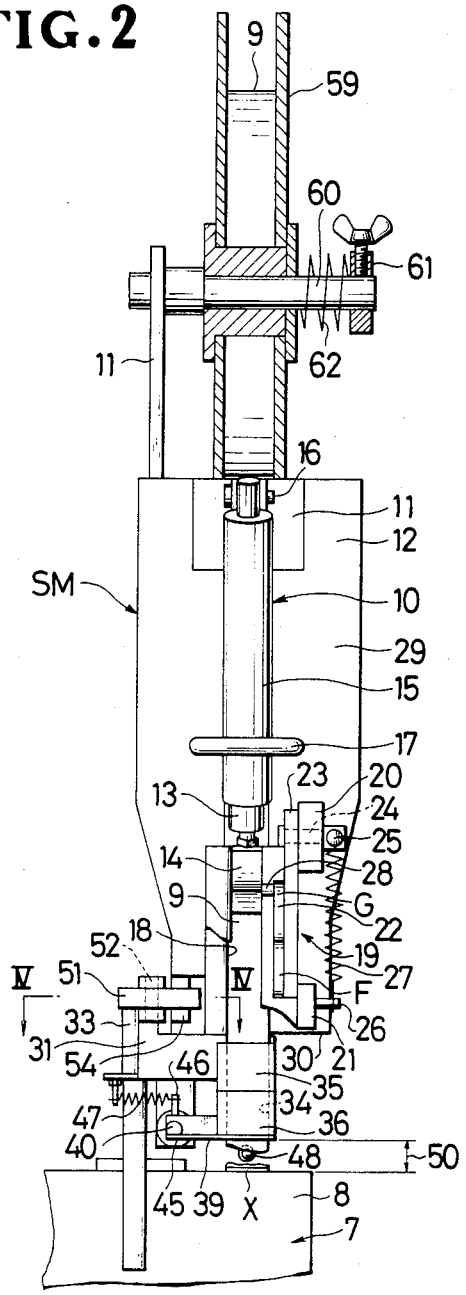
FIG. 2 is a front elevational view partly in cross section, of the apparatus.

As shown in FIGS. 1 and 2, the apparatus includes a sewing machine SM having a sewing station or position X on its base 7, and an intermittent tape feed unit 10 disposed above a front end 8 of the base 7 for intermittently feeding a continuous protective tape 9 downwardly toward a tape supply station or position on the base 7 which is located upstream of the sewing position X as viewed along a direction of feed of a slide fastener indicated by the arrow 0 shown in FIG. 1.

The tape feed unit 10 is composed of a vertical tape guide plate 12 secured to a frame 11 of the sewing machine SM, and a fluid-pressure cylinder actuator 15 having a tape feed member 14 connected to the front end of a piston rod 13 of the cylinder actuator 15. The cylinder actuator 15 is pivotally connected by a horizontal pin 16 to the sewing machine frame 11 and is normally urged by a resilient ring 17 to turn about the pin 16 in the counterclockwise direction in FIG. 1, so that the tape feed member 14 is held in resilient contact with a vertical tape guide groove 18 in the tape guide plate 12. The resilient ring 17 extends around the cylinder actuator 15 and is connected with the tape guide plate 12. The resilient ring 17 is preferably formed of a ring of a coil spring.

The tape feed member 14 is reciprocably movable along the tape guide groove 18 in response to operation of the cylinder actuator 15. As shown in FIGS. 2, 5 and 6(A) 6–(C), a cam device 19 is disposed on the tape guide plate 12 at one side of the path of reciprocating movement of the tape guide member 14.

Figure 5:
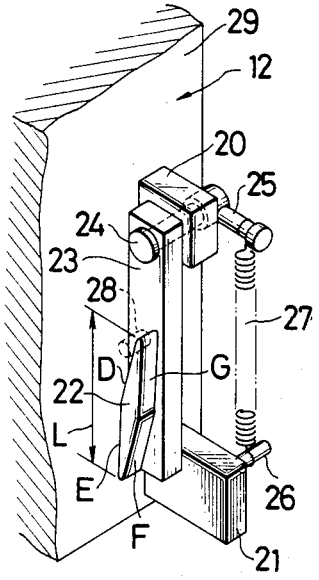
FIG. 5 is a perspective view showing a cam device incorporated in an intermittent tape feed unit of the apparatus.

As shown in FIGS. 2 and 5, the cam device 19 includes a pair of vertically aligned support lugs or brackets 20, 21 projecting horizontally outwardly from the tape guide plate 12, a rocking lever 23 pivotally connected by a horizontal pin 24 to the upper bracket 20, a plate cam 22 secured to one side face of the rocking lever 23, and a tension coil spring 27 extending between upper and lower retainer pins 25, 26 connected to the pin 24 and the lower bracket 21, respectively, for urging the rocking lever 23 into abutment with the tape guide plate 12.

The plate cam 22 is in the shape of a parallelogram in plan with its major axis extending vertically, the plate cam 22 having a length or vertical extent L equal to a stroke of the reciprocating movement of the tape feed member 14.

Figure 3:
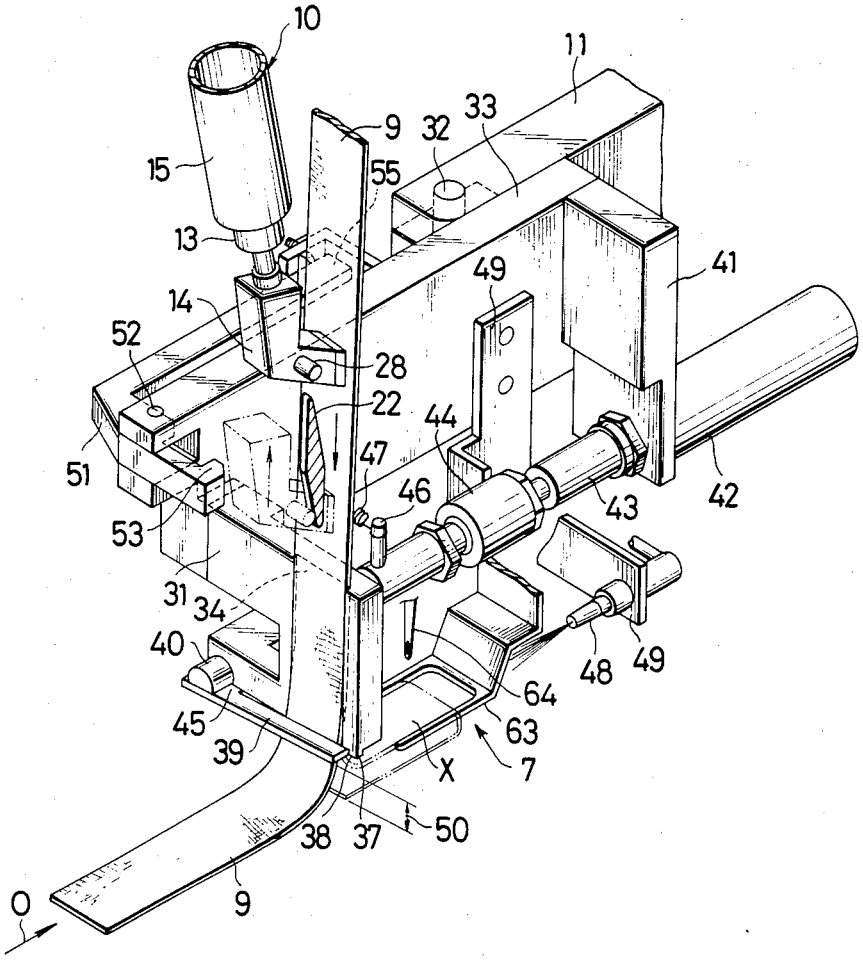
FIG. 3 is an enlarged perspective view of a main portion of the apparatus.
Figure 4:
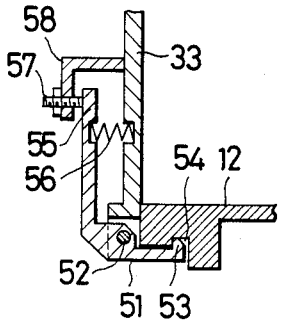
FIG. 4 is a cross-sectional view taken along line IV—IV of FIG. 2.

As shown in FIG. 3, the tape feed member 14 includes an actuating pin 28 projecting laterally outwardly toward the cam device 19 and engageable with a cam surface of the plate cam 22. The cam surface of the plate cam 22, as shown in FIGS. 5 and 6(A)–6(C), is composed of two opposite vertical sides E, G normally extending parallel to a front face 29 of the tape guide plate 12 and two opposite sides D, F extending obliquely upwardly outwardly with respect to the front face 29 of the tape guide plate 12.

Figure 6A:
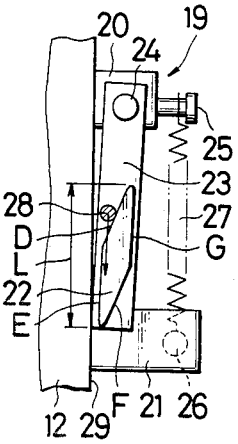
FIGS. 6(A) through 6(C) are side elevational views illustrative of a sequence of operation of the cam device.
Figure 6B:
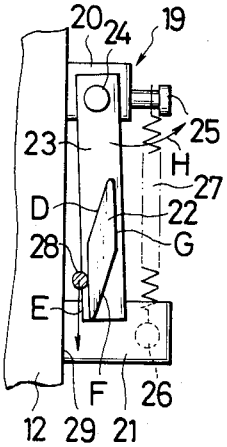

With this construction, when the cylinder actuator 15 is operated to extend its piston rod 13, the tape feed member 14 is lowered to feed the protective tape 9 downwardly along the tape guide groove 18 in the tape guide plate 12. The downward movement of the tape feed member 14 causes the actuating pin 28 to engage the upper oblique side D of the plate cam 22, as shown in FIG. 6(A). As the tape feed member 14 is further advanced, the actuating pin 28 slides downwardly along the upper oblique side D of the plate cam 22 to turn the rocking lever 23 in the direction of arrow H against the force of the tension coil spring 27 and then moves into sliding engagement with the inner vertical side E of the plate cam 22, as shown in FIG. 6(B).

Figure 6C:
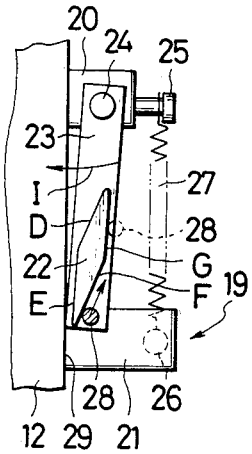

As described above, the length (vertical extent) L of the plate cam 22 is the same as the stroke of the reciprocating movement of the tape feed member 14. Therefore, if the actuating pin 28 and the plate cam 22 are set in such a positional relation that a lower peripheral portion of the actuating pin 28 is held in contact with a top apex of the plate cam 22 when the tape feed member 14 is disposed in its uppermost position, and an upper peripheral portion of the actuating pin 28 is held in contact with a bottom apex of the plate cam 22 when the tape feed member 14 is located in its lowermost position, then upon completion of downward movement of the tape feed member 14 for feeding a length of the protective tape 9, the actuating pin 28 will be disengaged from the bottom apex of the plate cam 22 as the rocking lever 23 is turned in the direction of arrow I under the force of the tension coil spring 27, as shown in FIG. 6(C). Immediately thereafter, the actuating pin 28 is brought into contact with the lower oblique side F of the plate cam 22 under the force of the resilient ring 17 (FIG. 1) tending to urge the cylinder actuator 15 in a direction to move the tape feed member 14 toward the front face 29 of the tape guide plate 12. Due to this engagement of the actuating pin 28 with the lower oblique side F, however, the tape feed member 14 is held out of contact with the protective tape 9 received in the guide groove 18 in the tape guide plate 12.

Then the tape feed member 14 is moved upwardly whereupon the actuating pin 28 slides upwardly along the lower oblique side F and then moves into sliding contact with the outer vertical side G of the plate cam 22 as indicated by dotted lines in FIG. 6(C). During that time, the tape feed member 14 is kept out of contact with the protective tape 9. When the tape feed member 14 arrives at its uppermost position, the actuating pin 28 is disengaged from the top apex of the plate cam 22 under the resiliency of the resilient ring 17 (FIG. 1) tending to urge the cylinder actuator 15 to turn in a direction to move the tape feed member 14 toward the front face 29 of the tape guide plate 12. The tape feed member 14 is thus brought into contact with the protective tape 9 again under the resiliency of the resilient ring 17.

As shown in FIGS. 1 through 3, a tape guide block 31 is disposed immediately below a lower end 30 of the tape guide plate 12. The tape guide block 31 is secured to the distal end of a side plate 33 pivotably connected by a vertical pin 32 to the frame 11. The tape guide block 31 has a vertical tape guide channel 34 defined in a front face of the tape guide block 31 directed to an upstream side of the slide fastener feeding direction of arrow 0, the tape guide channel 34 extending contiguous to the tape guide groove 18 in the tape guide plate 12. The tape guide channel 34 has a varying depth progressively reducing from an upper end to a lower end thereof such that at its upper end, the tape guide channel 34 has the same depth as the tape guide groove 18 and, at its lower end, the tape guide channel 34 blends into the front face of the tape guide block 31, as indicated by the dotted lines in FIG. 3. The tape guide channel 34 is covered by upper and lower covers 35, 36 (FIGS. 1 and 2) secured to the front face of the tape guide block 31.

The tape guide block 31 includes a cutting edge 38 formed along the front edge of a bottom surface 37 of the tape guide block 31. The cutting edge 38 cooperates with a horizontal cutter 39 to sever the protective tape 9, as described later on. The cutter 39 is horizontally movable in a direction perpendicular to the tape guide channel 34 in the tape guide block 31.

As shown in FIGS. 1, 3, 7 and 8, the cutter 39 is firmly connected to the front end of a horizontal shaft 40 extending across the tape guide block 31. The horizontal shaft 40 is connected by a universal joint 44 to a piston rod 43 of a fluid-pressure cylinder actuator 42 horizontally supported by a bracket 41 secured to the side plate 33. The universal joint 44 permits the shaft 40 to rotate about its own axis.

Figure 7:
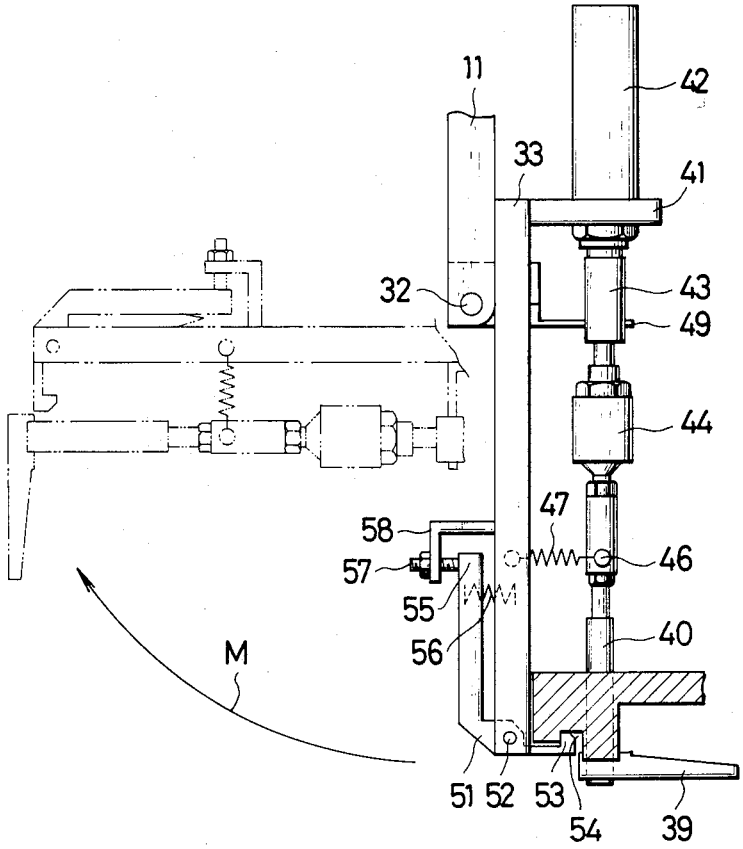
FIG. 7 is an enlarged plan view showing a pivotable side plate supporting thereon a cutter and a cutter actuation mechanism.
Figure 8:
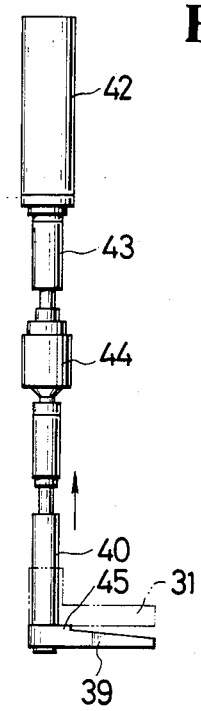
FIG. 8 is a plan view showing the operation of the cutter.
Figure 9:
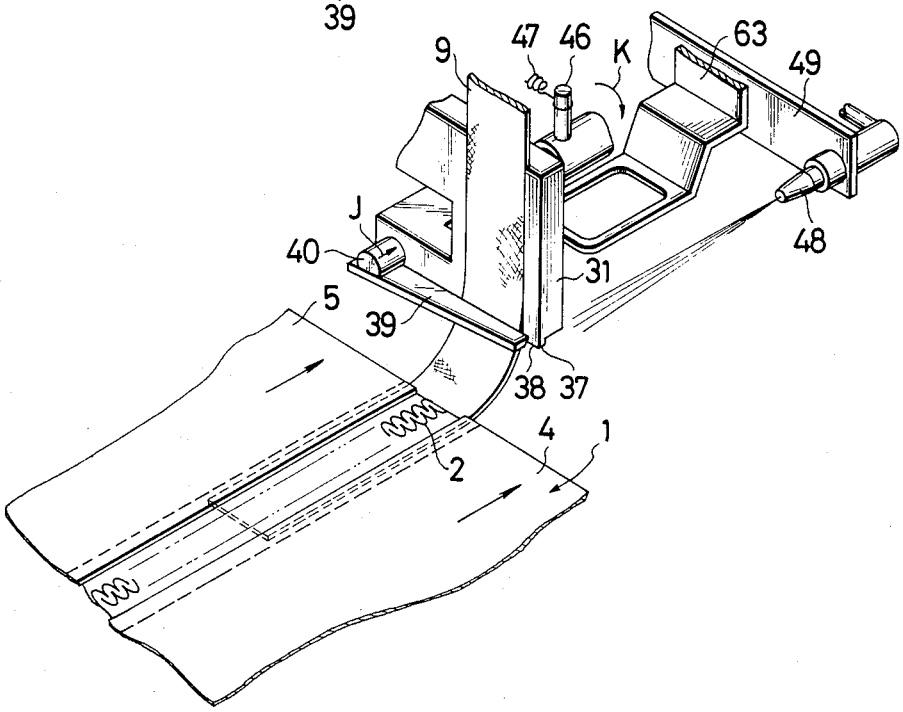
FIGS. 9 and 10 are fragmentary perspective views of the apparatus, showing the manner in which a protective strip is applied to the leading end of a slide fastener.

The cutter 39 serves to perform a scissors-like action relative to the stationary cutting edge 38 of the tape guide block 31 for cutting the protective tape 9. To this end, the cutter 39 is tapered widthwise toward the distal end thereof such that the cutter 39 and the cutting edge 38 normally define therebetween a substantially triangular space, as shown in FIGS. 7 and 8, and the proximal end 45 of the cutter 39 is always disposed in sliding contact with the bottom surface 37 of the tape guide block 31. With this construction, when the shaft 40 is retracted in the direction of arrow J, the cutter 39 is brought into sliding engagement with the botton surface 37 of the tape guide block 31 progressively from the proximal end to the distal end thereof, thereby severing the protective tape 9 by and between the movable cutter 39 and the stationary cutting edge 38. This sliding engagement causes the shaft 40 to be turned in the direction of arrow K against the force of a tension coil spring 47 which extends between the side plate 33 and a retainer pin 46 on the shaft 40 for urging the shaft 40 to turn about its own its axis in a direction opposite to the direction of arrow K, as shown in FIG. 9.

Upon completion of cutting, the shaft 40 is advanced in a direction opposite to the direction of arrow J and is returned to the standby position shown in FIG. 3 by the force of the tension coil spring 47.

An air nozzle 48 is disposed in a path of movement of the slide fastener at a position downstream of the sewing position X and directed upstream of the slide fastener feeding direction indicated by the arrow 0 for issuing a stream of pressurized air along the upper surface of the base against one surface of the protective tape 9. The air nozzle 48 is horizontally supported by a bracket 49 secured to the side plate 33.

As shown in FIGS. 1–3, the underside of the cutter 39 and the upper surface of the base 7 jointly define therebetween a fastener receiving-space 50. The height or vertical extent of the space 50 is determined such that a leading end of the protective tape 9 is properly folded into a U-shape extending from the back to the face of a slide fastener 1 around the leading end thereof when the slide fastener 1 is advanced through the fastener-receiving space 50.

As described above, the tape guid block 31, the cutter 39, the cylinder actuator 42 connected to the shaft 40, and the air nozzle 48 are mounted on the side plate 33 pivotably supported by the vertical pin 32 to the frame 11. The side plate 33 is normally held in a predetermined position relative to the frame 11 in which position, the tape guide block 31, the cutter 39 and the air nozzle 48 are disposed in alignment with the path of movement of the slide fastener 1. To hold the side plate 33 in this position, there is provided a positioning unit.

The positioning unit, as shown in FIGS. 2–5, includes an L-shaped locking lever 51 pivotably connected by a vertical pin 52 to the front end of the side plate 33 adjacent to the tape guide block 31. The locking lever 51 has a locking hook 53 projecting from one end thereof toward the tape guide plate 12. The tape guide plate 12 has a locking groove 54 lockingly engageable with the hook 53 on the locking lever 51. The positioning unit further includes a compression coil spring 56 acting between the locking lever 51 and the side plate 33 for urging the locking lever 51 to turn about the pin 52 in one direction to bring the locking hook 53 into interlocking engagement with the locking groove 54 in the tape guide plate 12. The pivotal movement of the locking lever 51 in this direction is limited by an adjustment screw 57 engageable with the other end 55 of the locking lever 51. The adjustment screw 57 is positionally adjustably mounted on a bracket 58 secured to the side plate 33. The hook 53 is released from locking engagement with the locking groove 54 when the locking lever 51 is turned in the opposite direction against the force of the compression coil spring 56, thereby allowing the side plate 33 to be turned about the pin 32 in the direction of arrow M to bring the components 31, 39, 42 and 48 into a position laterally remote from the path of movement of the slide fastener 1. With this arrangement, the maintenance of the sewing machine SM can be performed easily without interference with the components supported on the side plate 33.

As shown in FIGS. 1 and 2, the protcctive tape 9 is wound around a reel 59 rotatably mounted on a horizontal shaft 60 supported by the frame 11. A compression coil spring 62 is disposed around the shaft 60 and acts between the reel 59 and a retainer ring 61 secured to the shaft 60.

The spring 62 serves to exert a braking force to the reel 59 for preventing the reel 59 from overrunning by inertia as the protective tape is withdrawn from the reel 59. The sewing machine SM includes a presser foot 63 disposed in the sewing position X in which a sewing needle 64 is driven to reciprocate in a known manner.

The apparatus of the foregoing construction operates as follows.

The cylinder actuator 15 of the intermittent tape feed unit 10 is activated to extend its piston rod 13 whereupon the tape feed member 14 while being biased by the resilient ring 17 into resilient engagement with one surface of the continuous protective tape 9 is lowered to feed the protective tape 9 downwardly along the tape guide groove 18 and the tape guide channel 39 toward the supply portion on the base 7 while keeping the surface of the protective tape 9 facing opposite to the slide fastener feeding direction indicated by the arrow 0. The downward movement of the tape feed member 14 is terminated when the piston rod 13 is fully extended. In this instance, a leading end portion of the protective tape 9 is downwardly withdrawn from the bottom surface 37 of the tape guide block 31 by a predetermined length and a substantial part of the leading end portion is laid over the upper surface of the base 7.

Simultaneously with the activation of the cylinder actuator 15, the air nozzle 48 is activated to start issuing a stream of pressurized air upstream along the upper surface of the base 7. The pressurized air thus issued then impinges on the opposite surface of the protective tape 9, thereby bending the leading end portion of the protective tape 9 in a direction opposite to the slide fastener feeding direction indicated by the arrow 0 as the protection tape 9 is advanced (FIGS. 1–3). Thus, the air nozzle 48 constitutes means for bending the leading end portion of the protective tape 9. The activation of the air nozzle 48 may be retarded until arrival of the piston rod 13 of the cylinder actuator 15 at its fully extended position for saving the amount of consumption of pressurized air.

Then a slide fastener 1 is fed longitudinally along the path through the fastener-receiving space 50 until the leading end of the slide fastener 1 reaches the sewing position X. With this forward movement of the slide fastener 1, the leading end portion of the protective tape 9 is bent into a U-shape extending from the back to the face of the slide fastener 1 arond the leading end of the slide fastener 1 and covering an end portion of a pair of interengaged rows of coupling elements 2.

Upon arrival of the leading end of the slide fastener 1 at the sewing position X, the sewing machine SM is energized to lower the presser foot 63 to thereby force the U-shaped leading end portion of the protective tape 9 against the base 7 with the leading end of the slide fastener 1 firmly gripped by the U-shaped leading end portion of the protective tape 9. Then, the cylinder actuator 15 is operated to retract its piston rod 13, thereby returning the tape feed member 14 to the upper standby position. During this return trip, the tape feed member 14 is held out of contact with the protective tape 9 so as not to withdraw the protective tape 9 upwardly away from the base 7. At the same time, the air nozzle 48 is de-activated to terminate issuing the stream of pressurized air.

While keeping the holding of the leading end portion of the protective tape 9 and the leading end of the slide fastener 1, the cylinder actuator 42 is activated to retract its postion rod 43 and hence the shaft 40 connected to the piston rod 43 via the universal joint 44. The retracting movement of the shaft 40 causes the cutter 39 to be moved into coaction with the cutting edge 38 of the tape guide block 31, thereby cutting off a U-shaped protective strip from the continuous protective tape 9, as shown in FIG. 10.

Thereafter, the sewing needle 64 is reciprocated to thereby attach the protective strip 3 to the leading end of the slide fastener 1 by sewing stitches 6 extending transversely across the width of the protective strip 3. The protective strip 3 thus attached covers the end of the interengaged rows of coupling elements 2 to thereby prevent the latter from projecting to the outside of the slide fastener 1.

Upon completion of the sewing, the sewing machine SM is de-energized whereupon the presser foot 63 returns to its upper standby position, thereby releasing the end of the slide fastener 1. At the same time, the cylinder actuator 42 is operated to extend its piston rod 43, thereby moving the cutter 39 from the cutting position of FIG. 10 to the standby position of FIG. 3. The foregoing sequence of operation of the components (namely, the cylinder actuators 15, 42, the air nozzle 48 and the sewing machine SM) is performed under the control of suitable sensors (now shown) which are connected to the components to interlock their operations. The foregoing cycle of operation is repeated after the slide fastener 1 with the protective strip 3 sewn thereto is removed from the sewing position X.

The cutting operation may be performed without holding of the U-shaped leading end portion of the protective tape 9 and the leading end of the slide fastener 1 by the presser foot 63 in which instance the upward movement of the tape feed member 14 is retarded until after completion of the cutting operation.

Obviously, various modifications and variations of the present invention are possible in the light of the above teaching. It is therefore to be understood that within the scope of the appended claims the invention may be practiced otherwise than as specifically described.

What is claimed is:

1. An apparatus for applying a protective strip to an end of a slide fastener, comprising:

(a) a sewing machine including a base and a sewing needle reciprocably disposed above a sewing position defined on an upper surface of said base, said base further defining on its upper surface a tape supply position located upstream of said sewing position;

(b) an intermittent tape feed unit disposed above said tape supply position on said base for intermittently feeding a continuous protective tape downwardly toward said tape supply position while keeping one surface of the protective tape facing in a direction opposite to a direction of feed of a slide fastener facing toward said sewing position until a leading end portion of the protective tape overlays the upper surface of said base by a predetermined length;

(c) a tape guide block disposed between said intermittent tape feed unit and said base and spaced upwardly from the upper surface of said base so as to define therebetween a fastener-receiving space for the passage of double layers of the protective tape and the slide fastener, said tape guide block having a substantially vertical tape guide channel for guiding therealong the protective tape;

(d) a cutter assembly disposed adjacent to a lower end of said tape guide channel in said tape guide block for cutting off the leading portion of the protective tape from the continuous protective tape; and (e) means for bending the leading end portion of the protective tape toward said direction along the upper surface of said base.

2. An apparatus according to claim 1, said sewing machine further including a presser foot disposed above said sewing station and reciprocally movable toward and away from the upper surface of said base.

3. An apparatus according to claim 1, said intermittent tape feed unit including a tape guide plate disposed immediately above said tape guide block and having a vertical tape guide groove extending contiguously upwardly from said tape guide channel for receiving therein the protective tape, a tape feed member reciprocably movable along said tape guide groove, resilient means for urging said tape feed member into resilient contact with the protective tape received in said tape guide groove, a cam device disposed on said tape guide plate and engageable with said tape feed member for holding the latter out of contact with the protective tape received in said tape guide groove during the rearward stroke of the reciprocation of said tape feed member.

4. An apparatus according to claim 3, said intermittent tape feed unit further including a cylinder actuator pivotably connected to a frame of said sewing machine and having a piston rod connected with said tape feed member, said resilient member comprising a resilient ring extending around said cylinder actuator and connected to said tape guide plate.

5. An apparatus according to claim 3, said cam device including a rocking lever disposed on one side of said tape guide groove and normally urged against a front face of said tape guide plate in which said tape guide groove extends, a plate cam secured to said rocking lever and being of the shape of a parallelogram in plane having a major axis extending vertically and having a length equal to a stroke of reciprocation of said tape feed member, said parallelogram plate cam having an upper oblique side facing toward said front face of said tape guide plate, an inner vertical side extending contiguously downwardly from a lower end of said upper oblique side and facing toward said front face of said tape guide plate, a lower oblique side extending contiguously upwardly from a lower end of said inner vertical side in parallel relation to said upper oblique side, and an outer vertical side extending between an upper end of said lower oblique side and an upper end of said upper oblique side in parallel relation to said inner vertical side, said tape feed member having an actuating pin engageable with said cam surface and normally held in contact with said upper oblique side adjacent to a top apex of said parallelogram plate cam.

6. An apparatus according to claim 1, said cutter assembly including a stationary cutting edge extending along a front bottom edge of said tape guide block and a movable cutter reciprocably movable toward and away from said stationary cutting edge.

7. An apparatus according to claim 6, said tape guide channel having a varying depth progressively reducing in a downward direction such that at its upper end said tape guide channel fully receives therein the protective tape and, at its lower end, said tape guide channel blends into a front face of tape guide block.

8. An apparatus according to claim 6, said movable cutter being tapered widthwise from one end to the other end thereof so as to normally define between said stationary cutting edge a substantially triangular space, said one end of said cutter being held in sliding contact with a bottom surface of said tape guide block.

9. An apparatus according to claim 6, said cutter assembly further including a shaft connected at one of its opposite ends to said one end of said movable cutter and extending perpendicularly to said movable cutter, a universal joint, a cylinder actuator operatively connected to the other end of said shaft via said universal joint, and spring means for urging said shaft to turn about its own axis in one direction to bring said cutter into sliding contact with said bottom surface of said tape guide block.

10. An apparatus according to claim 1, said bending means comprising an air nozzle disposed downstream of said sewing position for issuing a stream of pressurized air along the upper surface of said base in a direction opposite to the direction of feed of the slide fastener.

11. An apparatus according to claim 1, said sewing machine including a frame, further including a side plate pivotably connected to said frame and supporting thereon said tape guide block, said cutter assembly and said bending means, said side plate being angularly movable in a horizontal plane between a first position in which said tape guide block, said cutter assembly and said bending means are disposed in alignment with a path of movement of the slide fastener, and a second position in which said tape guide block, said cutter assembly and said bending means are disposed laterally outwardly away from the path of movement of the slide fastener.

12. An apparatus according to claim 11, said bending means comprising an air nozzle supported on said side plate and disposed downstream of said sewing position, when said side plate is disposed in its first position, for issuing a stream of pressurized air along the upper surface of said base in a direction opposite to the direction of feed of the slide fastener.

13. An apparatus according to claim 11, further including means for holding said side plate in said first position.

14. An apparatus according to claim 13, said holding means including a locking lever pivotably connected to said side plate and releasably engageable with a portion of said intermittent feed unit when said side plate is disposed in said first position.

* * * * *